US012031310B2

(12) United States Patent
Sapp et al.

(10) Patent No.: US 12,031,310 B2
(45) Date of Patent: Jul. 9, 2024

(54) POP-UP DRAIN STOPPER AND ACTUATOR ASSEMBLY

(71) Applicant: COMPASS MANUFACTURING INTERNATIONAL, LLC, Louisville, KY (US)

(72) Inventors: Ken Sapp, Lakeville, MN (US); DeChang Li, Maspeth, NY (US)

(73) Assignee: COMPASS MANUFACTURING INTERNATIONAL, LLC, Louisville, KY (US)

( * ) Notice: Subject to any disclaimer, the term of this patent is extended or adjusted under 35 U.S.C. 154(b) by 86 days.

(21) Appl. No.: 17/889,365

(22) Filed: Aug. 16, 2022

(65) Prior Publication Data

US 2023/0148123 A1 May 11, 2023

Related U.S. Application Data

(63) Continuation-in-part of application No. 17/872,083, filed on Jul. 25, 2022.

(60) Provisional application No. 63/398,211, filed on Aug. 15, 2022, provisional application No. 63/233,706, filed on Aug. 16, 2021.

(51) Int. Cl.
*E03C 1/23* (2006.01)
*E03C 1/262* (2006.01)

(52) U.S. Cl.
CPC ..... *E03C 1/2302* (2013.01); *E03C 1/262* (2013.01)

(58) Field of Classification Search
CPC ..... E03C 1/2302; E03C 1/262; E03C 1/23; E03C 1/2306
USPC ..... 4/287, 286, 693, 290, 288, 292
See application file for complete search history.

(56) References Cited

U.S. PATENT DOCUMENTS 2,807,806 A * 10/1957 Watkins ..... E03C 1/2302 29/512
2,827,639 A * 3/1958 Schmidt ..... E03C 1/2302 285/55
4,622,701 A * 11/1986 Petursson ..... E03C 1/23 251/294
4,932,082 A * 6/1990 Ridgeway ..... E03C 1/2302 4/287

(Continued)

FOREIGN PATENT DOCUMENTS

CA 2546235 A1 * 11/2006 ..... E03C 1/23
CA 3132471 A1 * 3/2022 ..... E03C 1/2302

(Continued)

*Primary Examiner* — Lori L Baker
(74) *Attorney, Agent, or Firm* — CARRITHERS LAW OFFICE, PLLC; David W. Carrithers

(57) ABSTRACT

A drain control assembly having a pop-up stopper controlled by a cam actuating mechanism allowing the stopper to alternately seal and unseat from the drain opening by pressing down on the stopper. Actuator guide rings extending from vertical fins and tabs are used to align and removably secure the actuator in position within the drain pipe. The stopper seal seats against the sink housing the drain providing a water tight seal. The assembly has a removable catch screen to retain items fallen into the drain. The stopper and actuator assembly can be dislodged and the entire assembly removed and items in the catch screen can be retrieved or the actuator removed for cleaning. The assembly can then be reinstalled by simply inserting it down into the drain.

6 Claims, 10 Drawing Sheets

(56) References Cited

U.S. PATENT DOCUMENTS

| | | | | |
|---|---|---|---|---|
| 8,079,098 | B2 * | 12/2011 | Thomas | E03C 1/23 4/677 |
| 8,201,289 | B2 * | 6/2012 | Edmonds | E03C 1/232 4/690 |
| 11,549,246 | B1 * | 1/2023 | Mociran | E03C 1/2302 |
| 2004/0154095 | A1 * | 8/2004 | Rhodes | E03C 1/2306 4/684 |
| 2006/0000015 | A1 * | 1/2006 | Duncan | E03C 1/23 4/688 |
| 2008/0178382 | A1 * | 7/2008 | Pinette | E03C 1/2306 4/689 |
| 2009/0255054 | A1 * | 10/2009 | Duncan | E03C 1/23 4/689 |
| 2011/0185494 | A1 * | 8/2011 | Beck | E03C 1/2302 4/689 |
| 2016/0208470 | A1 * | 7/2016 | Franke | E03C 1/23 |
| 2017/0260724 | A1 * | 9/2017 | Beck | A47K 1/14 |
| 2017/0268212 | A1 * | 9/2017 | Calhoun | E03C 1/2302 |
| 2018/0258623 | A1 * | 9/2018 | Vong | E03C 1/2302 |

FOREIGN PATENT DOCUMENTS

| | | | | |
|---|---|---|---|---|
| CN | 218508578 U | * | 2/2023 | E03C 1/2306 |
| ES | 2921491 T3 | * | 8/2022 | E03C 1/23 |

* cited by examiner

POP-UP DRAIN STOPPER AND ACTUATOR ASSEMBLY

CROSS REFERENCE TO RELATED APPLICATIONS

This application claims priority from U.S. Provisional Application Ser. No. 63/233,706 filed on Aug. 16, 2021 and U.S. Provisional Application Ser. No. 63/398,211 filed on Aug. 15, 2022 and is a continuation-in-part of U.S. application Ser. No. 17/872,083 filed on Jul. 25, 2022 all of which are incorporated by reference herein in its entirety.

TECHNICAL FIELD

The present invention relates to the field of pop-up drain actuators for sinks.

BACKGROUND OF THE INVENTION

Conventional bathroom sinks are provided with a pup up drain stopper which is operated by a vertical rod rotatably connected to a horizontal rod which is also rotatably connected to the drain body whereby a spherical ball is integral to the horizontal rod and is rotatably captured within the drain body. Other pop up drain stoppers are raised simply by taping the top of the drain stopper and lowered by pushing down on the drain stopper until an internal locking device locks the stopper in a drain closing position. Both types of drain stoppers drain water from the sink when the stopper is in the upward and open position. If someone is draining the water by raising the stopper upwards it is possible for small articles to be washed down the drain in the gap between the cover and the sink basin.

A pop-up drain assembly is a drain with an option to seal the drain to hold water by simply pushing on it to close and to open. Conventional drain baskets teach a removable pop-up drain control with a detachable catch basket removable attached to a flange assembly supported by the actuating assembly separate from the stopper and cap or provides the screen or basket with vertical fingers extending down from a horizontal ring simply pressed onto a ridge or annular sealing flange of the stopper below the cover.

In addition, sinks and wash basins installed and used in bathrooms, kitchens, laundries and so on are always subject to overflow situations in the event that the drain lines become partially or totally clogged. A user may be unaware of the clogged drain or the incoming water may not have been turned off when a user leaves the room. In such an event, the sink will eventually overflow onto the floor and cause damage to the counter or floor.

The overflow in a sink serves two purposes, it diverts water back to the drain pipe and helps prevent water from spilling onto the counter or floor which could result in water damage. While effective, sink overflows are not designed to handle overflowing water. Water will still be rerouted to the drain, but the amount being evacuated likely won't be able to match the quantity filling the basin. Sink overflows also improve draining speed by allowing air into the piping.

Conventional sinks are fitted with overflow protection in the form of a built-in aperture defining a hole in the front or back side of the sink near the top edge of the sink, thus providing a path to drain the water which would otherwise overfill the sink and run out onto the floor. The hole carries the water down through a tunnel molded into the wall of the sink down to the sink drain. The drain pipe or drain body at the bottom of the sink which normally carries the water in the sink out to the sewer pipes in the house or building therefore must include a drain hole which allows the overflow water coming down the tunnel to escape into the same sewer pipes.

Not all sinks are fitted with the overflow holes and molded in tunnels for overflow protection. Designer sinks may be shaped of designed any a variety of configurations with no drain for aesthetic reasons. So, sinks are available in two categories, ones fitted with an extra drain overflow hole or port for at a selected elevation near the top of the sink for overflow water and sinks and bowls which do not include a drain overflow hole for an enhanced appearance.

SUMMARY OF THE INVENTION

The present invention comprises or consists of a pop-up drain control assembly for controlling flow through a drain opening in a sink or a basin. It includes a stopper or stopper type of cover" having an annular seal for cooperative engagement with a drain hole in a sink bowl.

A pop-up drain stopper assembly has a push type actuator assembly removable as a single unit for cleaning or replacement without the use of tools. The actuator is secured within the drain body having a base supported by a lip or step formed in the inner sidewall of the drain pipe. A medial guide ring and vertical fins are used with opposing guide tabs to removably secure the actuator in position within the drain pipe projecting upward from the actuator base in cooperative engagement with the inner side walls of the drain pipe biased there against using a flexible friction fit for easy cleaning access. A screen can be retro fitted to existing drain covers or formed integrally as part of the drain cover for threaded engagement with a threaded member extending upward from the actuator in order to prevent small articles from passing through and going down the drain.

The drain stopper assembly has a pop-up stopper and cover controlled by a cam actuating mechanism allowing the stopper to alternately seal and unseat from the drain opening by depressing the stopper. The stopper may have an annular seal and seats against the drain housing or a tub or sink basin. The stopper assembly has integral cover and catch basket that serves to both retain items fallen into the drain and removably mount the assembly to a threaded stem support extending through the drain conduit beneath the drain opening. The integral stopper and basket assembly can be unscrewed and removed so items retained by the catch basket can be retrieved. The stopper assembly can then be reinstalled by threading it onto the support stem of the actuator assembly.

The drain assembly which includes a knockout blank which can be used in drain assemblies in sinks without overflow and in sinks which include overflow apertures and therefore require drain assemblies having an overflow aperture in the upper sidewall portion of the sink. Leaving the drain assembly knockout blank intact forms an integral sidewall portion that provides a water tight seal for use in a sink that doesn't have overflow protection, and the integral sidewall portion knockout blank be removed by applying enough pressure against the sidewall portion to cleanly tear away and remove the knock-out portion from the drain wall body. Thus, the drain assembly in the instant invention can be used with a sink without overflow protection or can be easily modified for use in a sink with built in overflow protection by simply popping the sidewall portion out of the drain.

This screen can be retro fitted to existing drain covers or formed integrally as part of the drain cover for a sink drain assembly generally used for a bathroom sink, comprising a drain body, a drain stopper, a cam actuating mechanism raising and lowering a support rod or stem attached to the drain stopper.

This screen is formed integrally or as a friction fit accessory to be fitted to the drain cover for a drain for a sink or tub comprising a drain body, an integral drain stopper and cover and cylindrical sleeve screen having sidewalls. The basket bottom rim is of a slightly larger diameter extending outwardly forming a bottom basket rim slidably movable and contiguous with the sidewall of the drain to prevent articles from flowing into the drain conduit. Means for raising and lowering the drain stopper includes a lock ring securing the actuating means for raising and lowering the drain stopper to the drain body, and a vertical rod having a threaded distal end defining a stem for threadably affixing the stopper thereto. The basket screens the water passing through the drain in order to prevent small articles from passing through and going down the drain.

The stopper assembly includes a drain assembly controlled by a cam actuating mechanism allowing the stopper to alternately seal and unseat from the drain opening by depressing the stopper. An annular seal seats against the sink or tub structure housing the drain to create a positive watertight seal. The stopper assembly with integral catch basket that serves to both retain items fallen into the drain and removably mount the assembly to a stem support member beneath the drain opening for controlling flow through the drain. The stopper assembly can be unscrewed to remove the stopper, cover, basket and cam actuating mechanism can be dislodged so that the entire assembly can be removed and items in the catch basket can be retrieved. The assembly can then be reinstalled by simply inserting it down into the drain as opposed to conventional actuator assemblies such as is taught in the prior art such as U.S. Pat. No. 8,214,942.

The stopper includes generally flat cover having a central axial sleeve extending from the bottom surface, whereby the central axial sleeve includes inner threads for threadably receiving threads of a post or stem extending from an actuator having a threaded distal end for supporting and mounting the stopper at one end thereof.

A larger diameter outer coaxial sleeve extends downward from the bottom surface of the stopper past the central axial sleeve. An upper portion of the outer coaxial sleeve includes a first coaxial ridge extending normal to and around the outer surface spaced apart from the bottom surface of the stopper forming a lip of step where the diameter of the drain pipe has a reduced diameter at the junction of the drain actuator assembly portion and the threaded portion. The first coaxial ridge has an external diameter less than that of the inner diameter of the drain. A second coaxial ridge forms the upper rim of the lower portion of the coaxial sleeve defining a cylindrical sleeve screen with the sidewalls extending outwardly the same distance as the first coaxial ridge. The sleeve screen includes openings between vertical members such as bars extending from the top of the sleeve screen to a bottom base rim having a slightly larger diameter.

A water tight sealing member is disposed between first coaxial ridge and the second coaxial ridge. The sealing member comprises an O-ring, washer, or gasket having a flat outer surface and raised inner surface composed of a resilient type of material such as rubber, a polymer, an elastomer or other soft stretchable material.

The bottom portion of the integral coaxial sleeve defining the sleeve basket extends downward a length sufficient to contact the sides of the drain conduit with the coaxial basket sleeve base rim forming a seal with a drain conduit and allowing water to flow through at least one and preferably a plurality of openings in the coaxial sleeve sidewall from the sink into the drain preventing oversized articles larger than the plurality of openings from entering the drain pipe.

In accordance with the present invention, there is provided a screening basket for use on a drain stopper having a cap. The drain stopper is used in a sink having a drain hole. The screening basket comprises at least two horizontal, spaced apart rings connected, one ring above another, to one another by a plurality of spaced apart vertical fingers. The upper portion is connected to the bottom side of a drain stopper cap. The preferred outer diameter is about one sixteenth inch less than the diameter of the drain hole in the bottom of the sink.

Conventional drain assemblies have a body comprising a hollow cylinder having either solid upper body portion or an upper body sidewall portion including an opening. The drain assembly of the present invention includes an upper body sidewall portion having a optional a knock out blank which may be left in place or knocked out for use with either type of sink. A knock-out band can be used in combination with the knock-out drain assembly body to be positioned over the knocked out body hole providing a water tight seal should the user chooses to use the knocked out drain assembly in a sink having a conventional overflow port.

The sink drain comprises a longitudinal cylinder having a hollow core. The drain has a lower smooth surface portion, a middle portion with exterior threads, and an upper smooth surface portion terminating with a flange. The longitudinal cylinder has a given general wall thickness of about 3 millimeters, but the optional knockout blank portion integrally formed in the sidewall of the drain is slightly thinner having a thickness of about two millimeters, sometimes with an even thinner perimeter or seam, sometimes called a breaking seam of about one to two millimeters, and typically slightly less than two millimeters), to facilitate knocking out the blank forming a clean aperture or opening in the sidewall of the drain pipe. The outer surface of the drain sidewall forming the blank body is thinner than the main general drain sidewall thickness which is, for example, about three millimeters. The thinner perimeter provides for easy removal of the sidewall portion, if desired, minimizing risk of damage to the drain conduit.

It is an object of this invention to provide a drain having a drain body which includes a optional knockout blank which when removed forms an aperture in the sidewall near the upper inlet of the drain body which aligns with the overflow outlet of a given sink containing an overflow hole and an integral tunnel through which overflow water drains.

It is an object of this invention to provide a sink drain with a pop up drain stopper which includes a screening basket attached to the drain stopper under the cap of the drain stopper, wherein the basket catches small articles like jewelry, contact lenses and other items which are valuable to the homeowner or which could cause future problems in the drainage pipes.

It is an object of the present invention to provide a sink drain stopper including a screen or basket which catches or prevents small items from falling into the drain hole when the drain stopper is raised in order to drain the sink.

It is an object of the present invention to provide a screen for water passing through the drain in order to prevent small articles such as jewelry, contact lenses or other small articles from passing through and going down the drain. When lowered the basket screen does not cover the overflow openings in the drain body to prevent overflow of the sink or tub due to blockage of the drain basket with articles or debris.

More particularly, the present invention discloses a sink drain stopper including a screen or basket which catches or prevents small items from falling into the drain hole when the drain stopper is raised in order to drain the sink It is an object of the present invention to provide a sink drain with a pop up drain stopper including a screening basket comprising a number of horizontal rings integral with vertical fingers forming a cylindrically shaped basket which is open at both ends.

It is an object of this invention to provide a drain assembly which includes a knockout blank which can be used in drain assemblies in sinks without overflow and in sinks which include overflow apertures and therefore require drain assemblies having an overflow aperture in the upper sidewall portion of the sink. Leaving the drain assembly knockout blank intact forms an integral sidewall portion that provides a water tight seal for use in a sink that doesn't have overflow protection, and the integral sidewall portion knockout blank be removed by applying enough pressure against the sidewall portion to cleanly tear away and remove the knock-out portion from the drain wall body. Thus, the drain assembly in the instant invention can be used with a sink without overflow protection or can be easily modified for use in a sink with built in overflow protection by simply popping the sidewall portion out of the drain.

It is an object of the present invention to provide an knock-out band to cover a drain assembly having a knockout blank removed and the user wishes to use the drain assembly in a sink having a separate dedicated overflow.

It is an object of the present invention to provide a band slidable, rotatable or movable over the knock-out hole formed in a drain conduit and stretchable or at least resilient enough to slide over the drain conduit and cover the knockout hole providing an effective water tight seal.

It is an object to provide a band which is elastic and has sufficient memory to snap back tightly over the knock-out hole providing a water tight seal.

It is an object to provide a band or "sleeve" or "ring" comprising a thin, preferably flat band having dimensions sufficient to allow the width of the band to cover the knock-out opening when positioned there over forming a water tight seal.

It is an object of the present invention to provide a band including a raised area which fits in and cooperatively engages the knock-out hole to provide a tighter fitting seal and easy alignment and improve in proper positioning of the band over the knock-out opening.

It is another object to provide a band which can be rotated around the outer surface of the cylindrical drain body and/or can slide up or down or turned over to cover or uncover the knock-out hole.

It is another object of the present invention to provide a band for covering one or more knock-out holes aligned horizontally in the side wall of a drain assembly.

It is another object of the present invention for a knockout band to include at least one raised portion which corresponds in size and shape to the knock-out blank opening.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
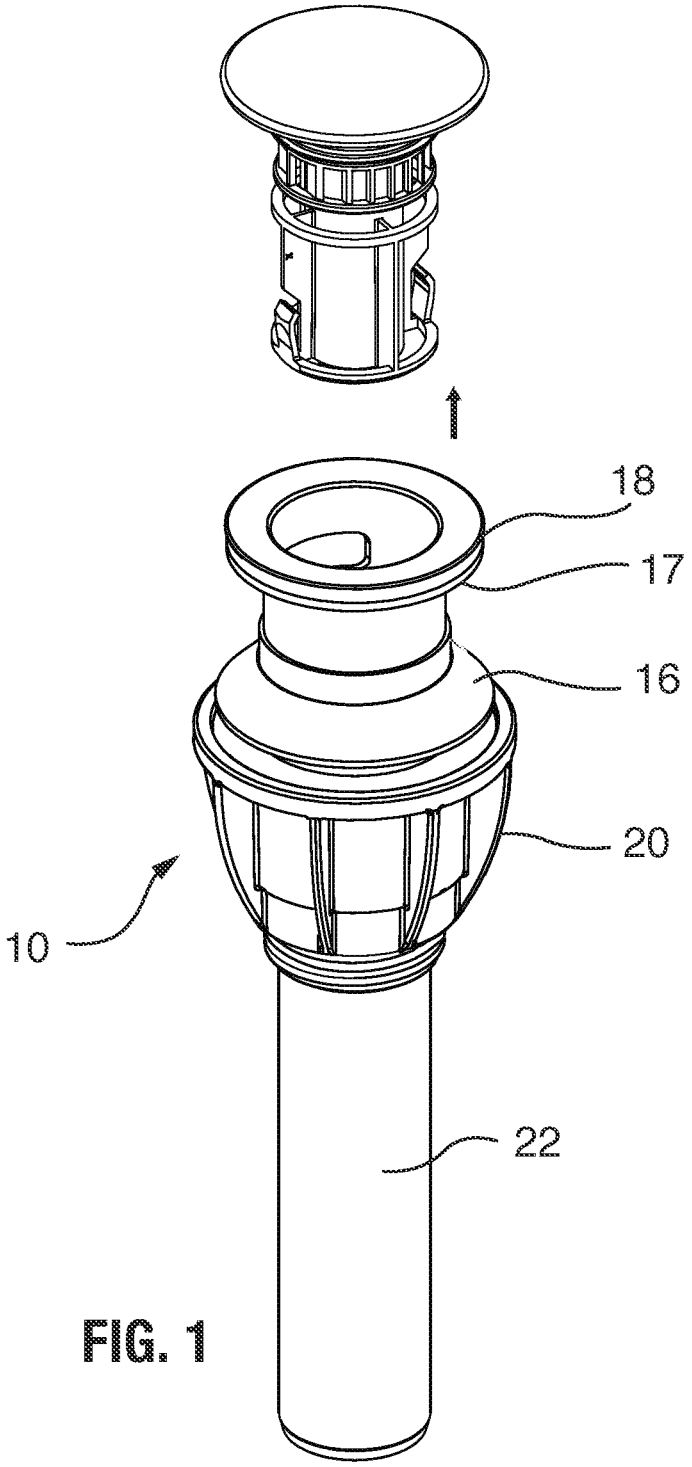
FIG. 1 is a perspective exploded view of the drain tube or "drain conduit" having an upper portion showing a band covering a knock out aperture, a medial threaded portion for threadably engaging the nut, and a lower conduct portion, including a nut and seal affixed and the actuator assembly including a strainer basket disposed around the stem below the lid cover for staining fluid entering the drain.

In accordance with the present invention, there is provided a drain assembly having a knock-out blank providing an drain assembly for use in sinks with or without a drain overflow together with a knock-out band to cover a hole formed from a knock-out blank in order for the drain assembly to be re-purposed for a sink including a drain overflow.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The term knock-out band is synonymous with a knock-out sleeve or knock-out ring.

The term knock-out blank is synonymous with knock-out tab.

The term plug is synonymous with stopper.

The term cap is synonymous with cover.

The term drain conduit is synonymous with drain pipe and drain tube.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Example embodiments will now be described more fully with reference to the accompanying drawings in FIGS. 1-16.

In accordance with the present invention, there is provided a push-pull drain assembly for use with a conventional sink having an opening in the sink body affording overflow protection or a drain assembly including an opening in the drain tube for overflow protection. Overflow protection in a sink provided with an overflow opening includes an aperture or hole 5 formed near to the top of the sink wall and in the inner sidewall of the sink body leading to a conduit or tunnel within the sink wall which carries the water to the bottom area of the sink. Some sinks may also be cast having an inner and outer shell whereby water flows between the linings to the drain.

Many bathroom sinks are supplied with a pop up drain stopper which is operated by raising or lowering a vertical rod which is rotatably connected to a horizontal rod which is rotatably attached to the drain assembly and to an inner drain stopper.

The knockout blank of the instant invention provides a means for providing a single drain which can be easily modified on site to be used in a sealed drain or drain having an overflow port. The sidewall portion defining a knock-out blank or tab 12 can be removed without special tools by snapping that portion away from the upper sidewall portion 103 of the drain 10. A linear rod or tools such as the shank of a screwdriver can be biased or pressed against the knockout blank which is shaped as a oval or rectangle having rounded corners. Thus removal of the sidewall portion 12 from the drain upper sidewall 22 can be accomplished by placing a portion of a tool, such as the shaft of a screwdriver, against the sidewall portion and pressing the portion 12 into the drain 10 until the portion 12 is broken free from the upper sidewall 22.

The knockout blank 12 is integrally formed in the sidewall 22 of the upper sidewall portion 103 so that each have a smooth inner wall surface, but the outer exterior surface of the drain blank is recessed inward an effective depth of about 1 millimeter so that the exterior surface of the drain sidewall 22 extends outward further than the knockout blank 12. Thus, the knockout blank 12 has a lower side profile than the drain sidewall 22. The lower profile helps position the tool and prevent it from moving during the procedure to pry open or break the knockout blank away from the sidewall 22.

The longitudinal cylinder forming the upper drain tube sidewall 22 has a given general wall thickness of about 3 millimeters and the knockout blank 12 has a thickness of about two millimeters with an even thinner perimeter or seam (about one to two millimeters, and typically less than two millimeters), to facilitate knocking out forming a clean aperture. The blank body 12 should always be thinner than the main general drain wall thickness to provide for easy removal of the sidewall portion, if desired, minimizing risk of damage to the drain conduit.

The sidewall blank 12 is connected to the drain 10 by a thin wall portion 13 around the perimeter of the sidewall portion. It is anticipated that the drain 10 may comprise a thermoplastic or other plastic, or composite material as well as a metallic substance. Where a thermoplastic is used, a general wall thickness may be about two millimeters or more and the thin wall portion may be around three tenths of a millimeter to provide an easily removable sidewall portion which can otherwise be left intact and will provide for water tight fluid drainage. This thin wall connection makes the breaking and removal of the sidewall portion an easy task to perform. The sidewall portion forming the blank 12 may then be discarded. The overflow water is carried down to the bottom of the sink and drains through the overflow aperture 14 formed in the sidewall 22 of the drain assembly 10 by removal of the knockout blank 12.

The drain assembly 10 comprises a longitudinal cylinder 22 having a hollow core and containing a lower smooth surface portion 101, a middle threaded portion 102, and an upper smooth surface portion 103 terminating with a flange 18. A flange gasket 17 is installed on to the drain assembly 10 just under the flange 18. The drain 10 is inserted downward through the drain hole in the bottom of a sink 1. A rubber washer 16 is then installed onto the drain assembly 10. Next the nut 20 is threaded onto the threaded portion 102 until the nut tightly compresses the rubber gasket 16 and the flange gasket 17 against the sink drain forming a water tight seal.

It is anticipated that the overflow aperture 14 and thus, the sidewall portion 12 is about one quarter inch to three eighths of an inch high by about three to five quarters of an inch wide and is centered about one half inch below the flange 18. Further, a second overflow aperture 14 and sidewall portion 12 may be provide on the opposite side of the drain assembly 10.

Figure 2:
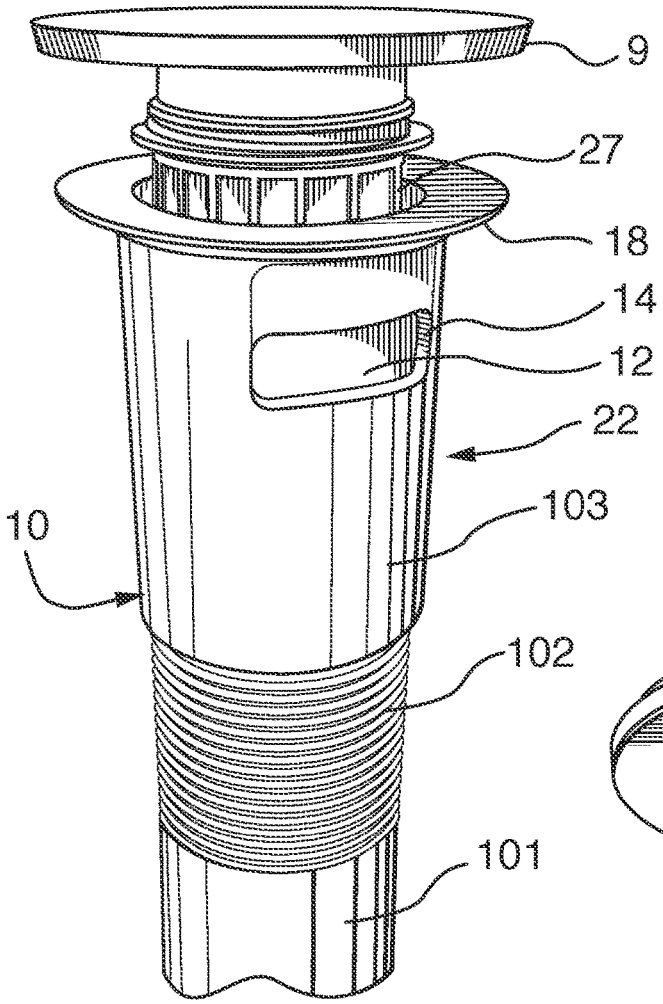
FIG. 2 is a perspective exploded view of the drain tube or "drain conduit" of FIG. 1, having an upper portion showing a knock out aperture, a medial threaded portion for threadably engaging the nut, and a lower conduct portion, wherein the actuator assembly including a strainer basket is inserted into the drain tube with the basket showing below the lid cover for staining fluid entering the drain.
Figure 3:
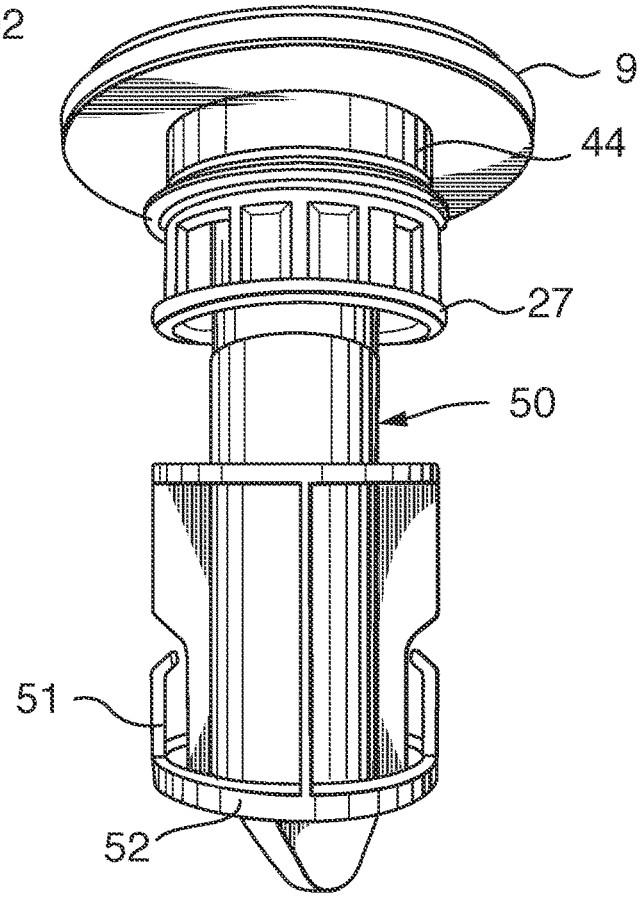
FIG. 3 is a perspective view of the actuator assembly of FIG. 1 showing the actuator housing having vertical flanges and guide tabs extending from the sides on a lower portion of the housing with a horizontal medial ring and bottom base ring attaching to and extending from the outer edges of the vertical flanges and guide tabs for aligning and cooperative slidable engagement with the inner wall of the drain body conduit.
Figure 4:
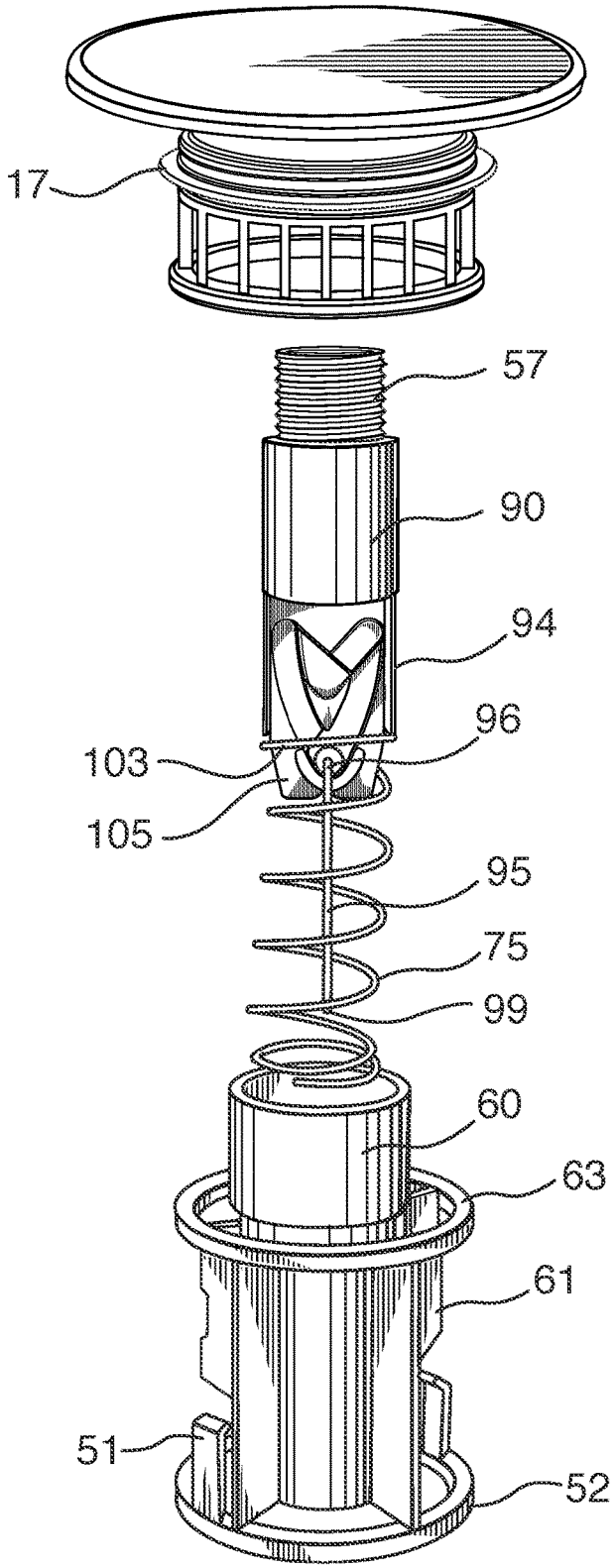
FIG. 4 shows an exploded view of the actuator on FIG. 1 having a stopper with a cover and seal attaching to a removable screen, a threaded top stem and integral cam travel groove path formed in on a recessed face of a bottom portion of a support stem; a longitudinal cam following pin having a top distal end disposed in a cam travel groove path and projecting downward into a coiled spring having a top end cooperatively engaging the bottom of the support stem for insertion into a actuator housing.
Figure 5:
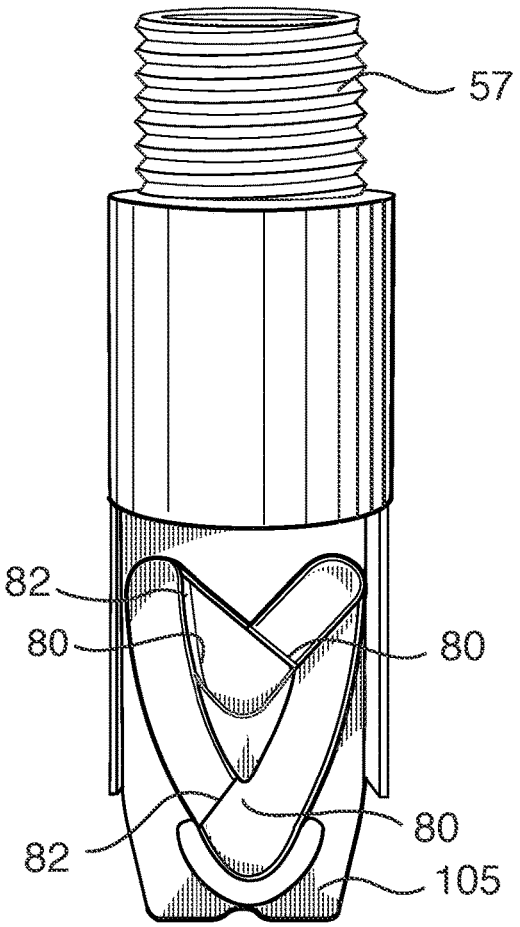
FIG. 5 shows the support stem of FIG. 4 having a threaded top stem and integral cam travel groove path formed in on a recessed face of a bottom portion.
Figure 6:
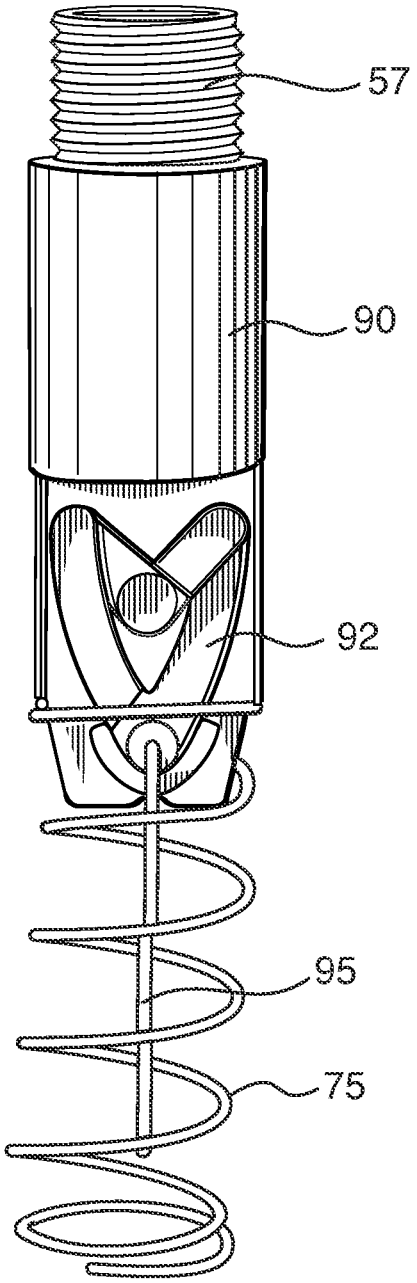
FIG. 6 shows an exploded view of the support stem of FIG. 5 having a threaded top stem and integral cam travel groove path formed in on a recessed face of a bottom portion of a support stem and a longitudinal cam following pin having a top distal end disposed in a cam travel groove path and projecting downward into a coiled spring having a top end cooperatively engaging the bottom of the support stem.
Figure 7:
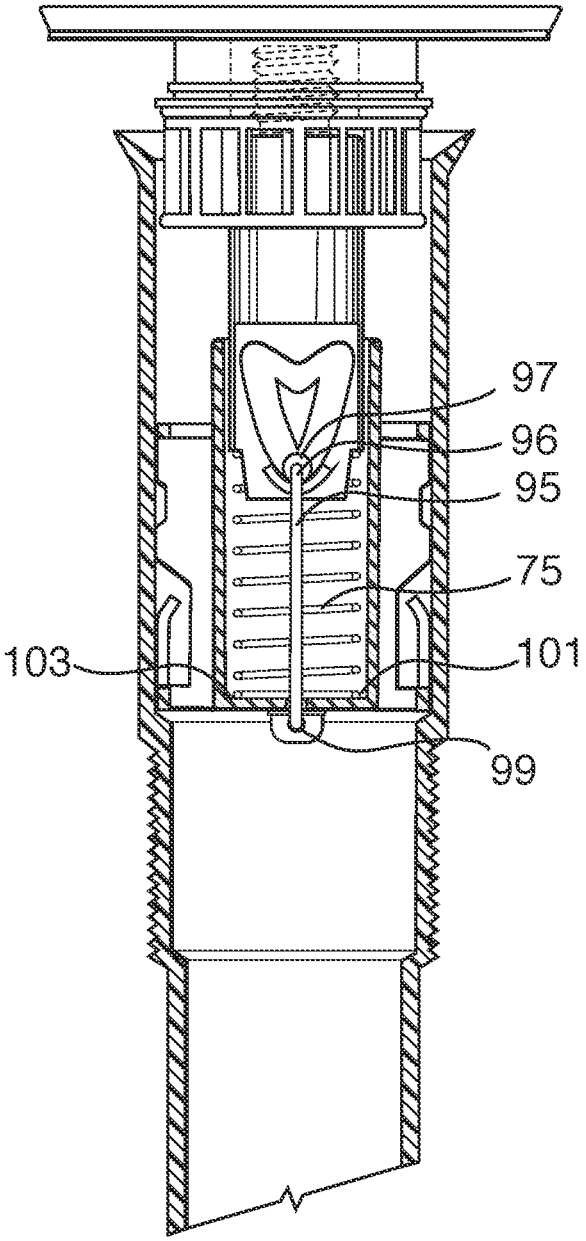
FIG. 7 is a sectional view of the drain and actuator assembly of FIG. 1, showing the stopper and cover in the open position with the spring extended and the cam following pin engaging the bottom portion of the heart shaped cam track groove.
Figure 8:
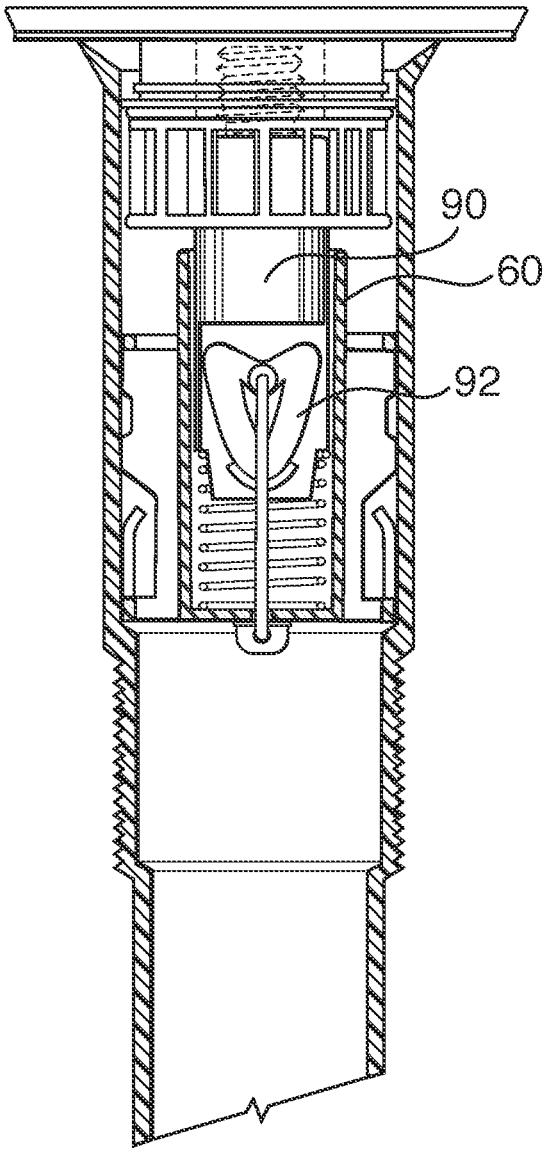
FIG. 8 is a sectional view of the drain and actuator assembly of FIG. 1, showing the stopper and cover in the closed position with the spring depressed and the cam following pin engaging the top center portion of the heart shaped cam track groove.
Figure 9:
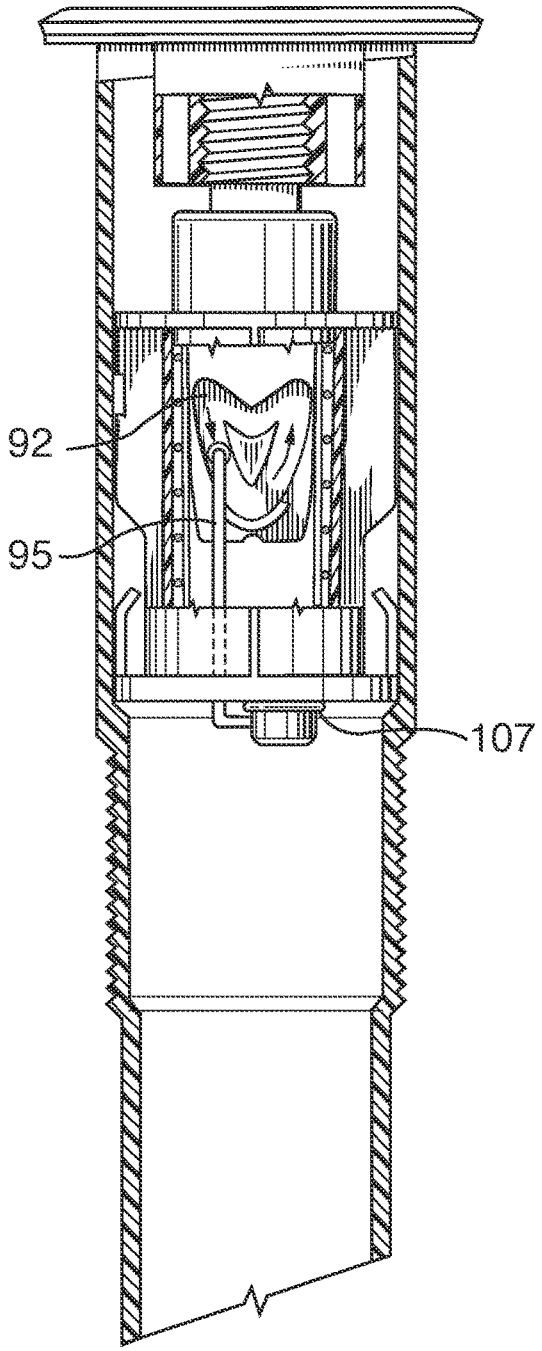
FIG. 9 is a sectional view of the drain and actuator assembly of FIG. 1, the cam following pin engaging a medial portion on the left side of the heart shaped cam track groove.
Figure 10:
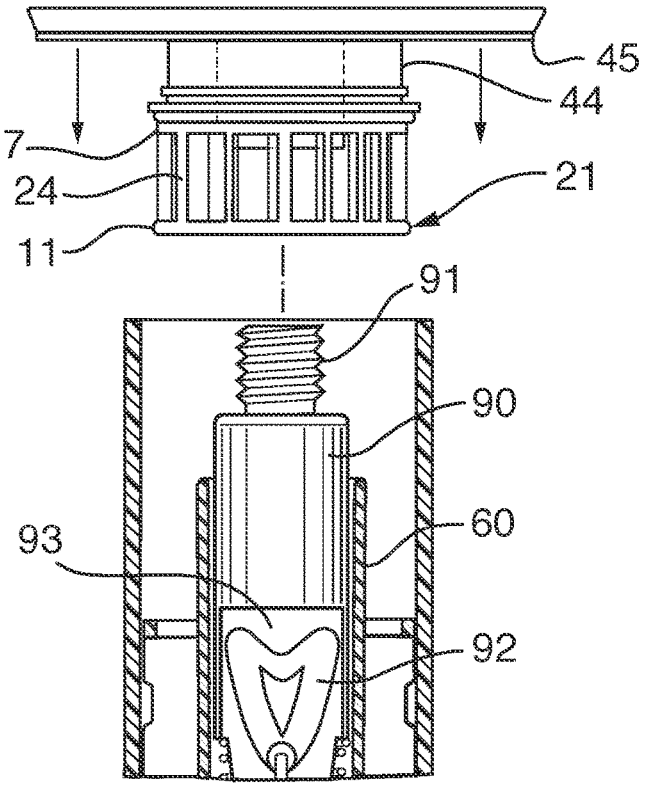
FIG. 10 is a sectional view of the drain and actuator assembly of FIG. 1, showing the stopper, cover, and removable screen positioned above and in alignment with the threaded top portion of the support stem.
Figure 11:
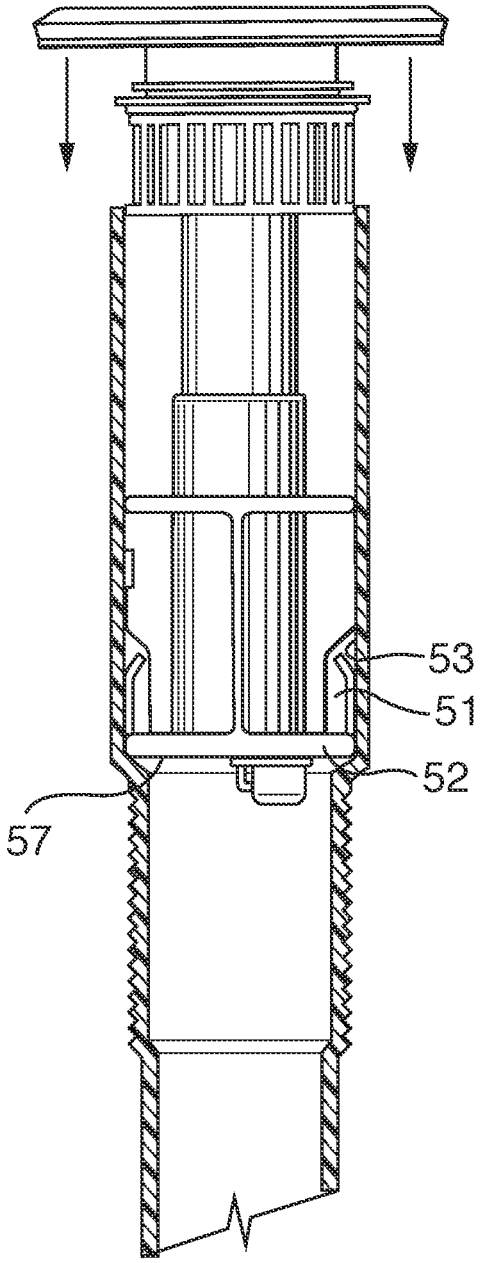
FIG. 11 is a sectional view of the drain and actuator assembly of FIG. 1, showing the stopper and cover in the open position and the support stem extending from the actuator housing.
Figure 12:
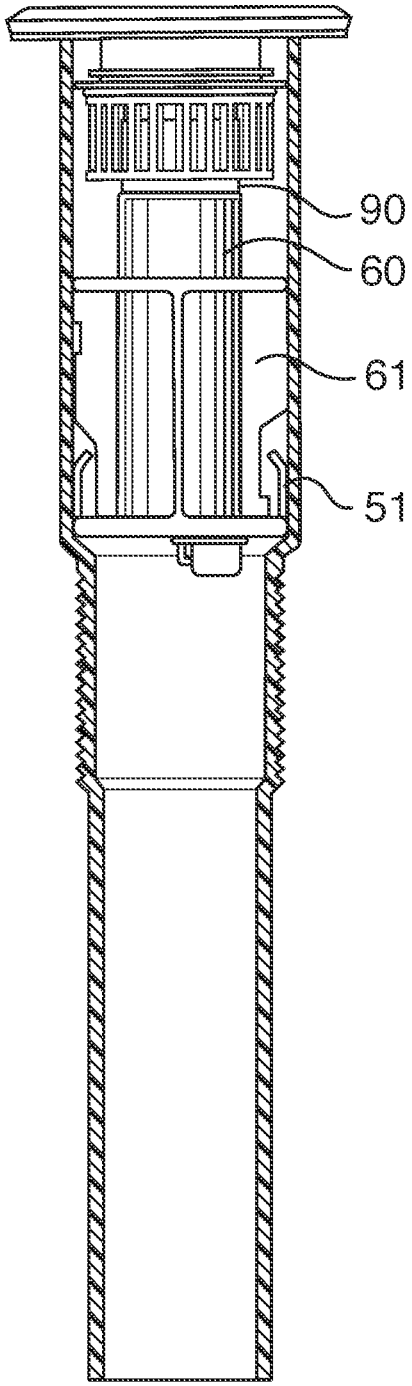
FIG. 12 is a sectional view of the drain and actuator assembly of FIG. 1, showing the stopper and cover in the closed position and the support stem inserted down into the actuator housing.
Figure 13:
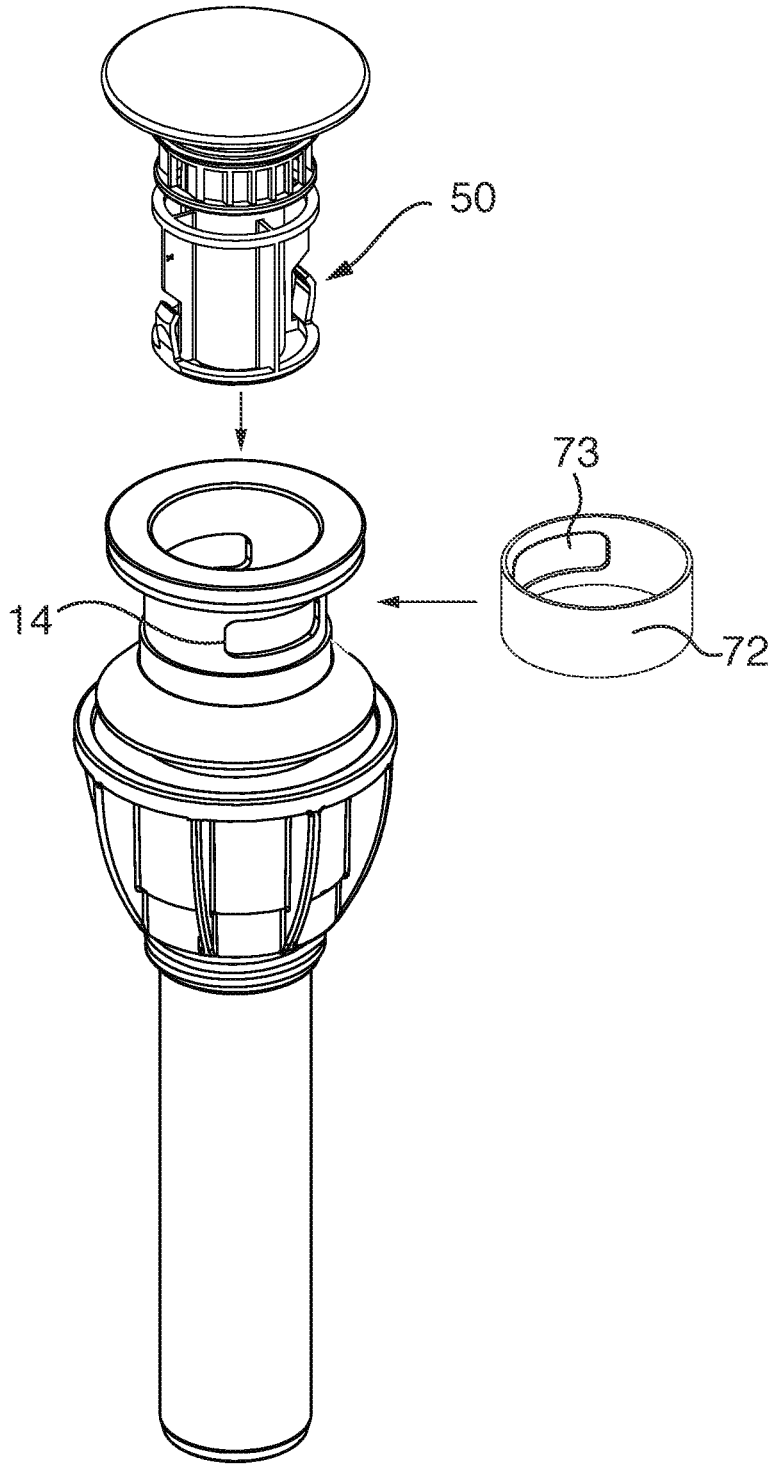
FIG. 13 is a perspective exploded view of the drain and actuator assembly of FIG. 1, wherein the drain conduit has an upper portion showing a an opening in the upper portion of the drain and showing a band for covering the knockout opening forming a water tight seal therewith.
Figure 14:
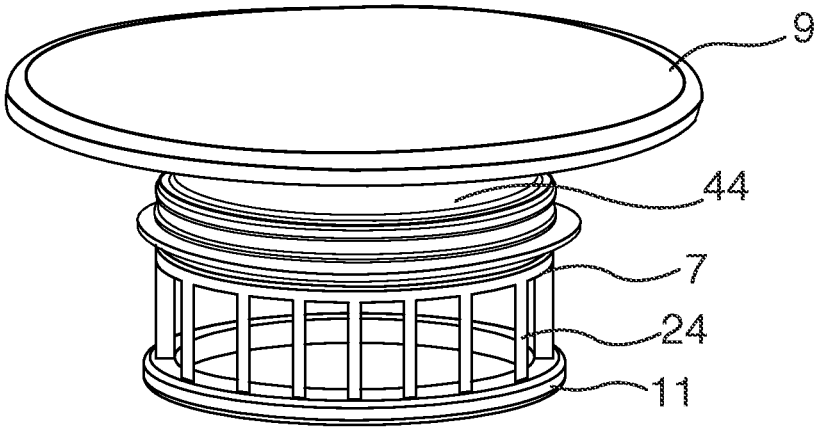
FIG. 14 is a side view of the stopper, cover, and screen of the drain assembly of FIG. 1, showing an article wedged against the screen.
Figure 15:
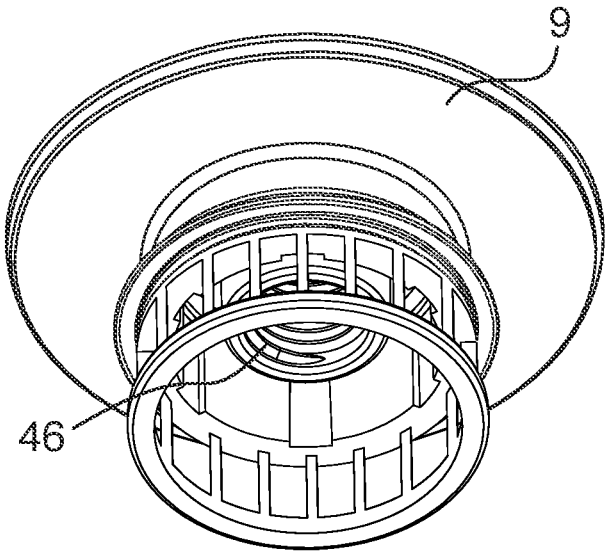
FIG. 15 is a perspective view of the stopper, cover, and screen fo the drain assembly of FIG. 1 showing the seal and screen, and threaded cavity formed in the stopper for cooperative engagement with the threaded stem of the actuator support stem.
Figure 16:
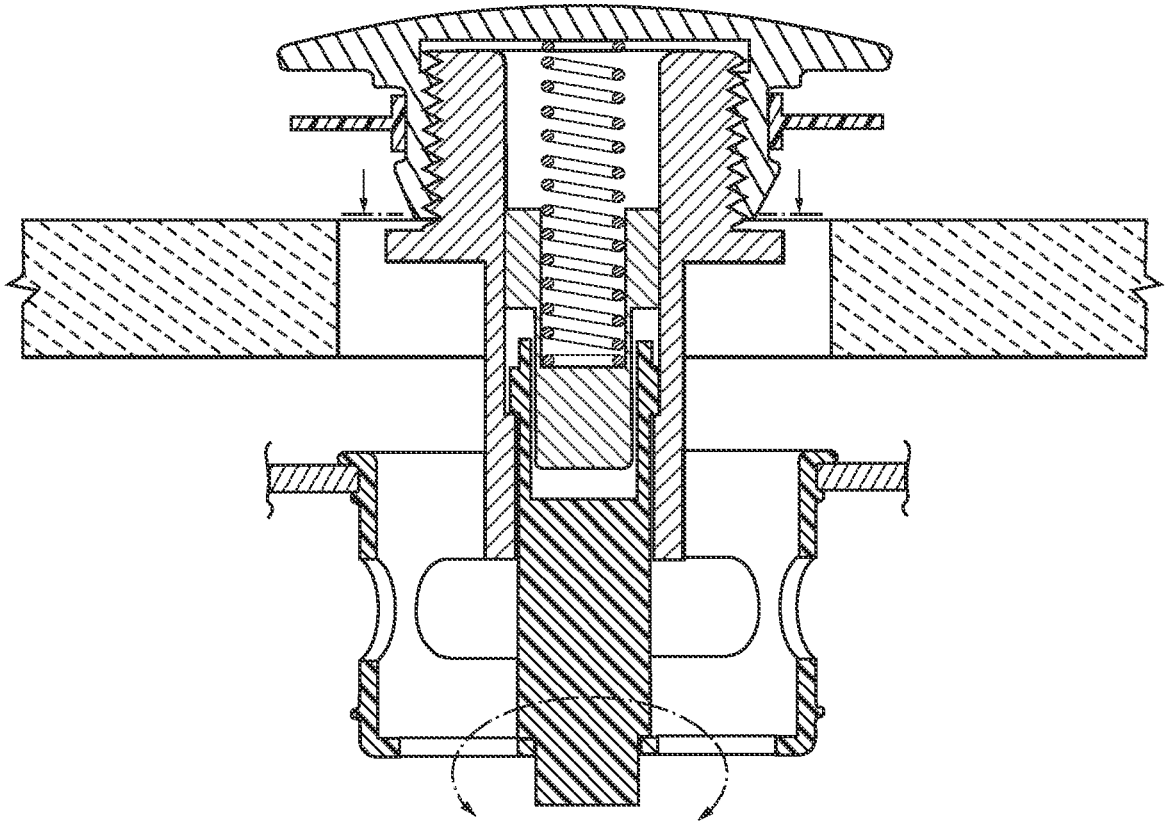
FIG. 16 PRIOR ART
FIG. 16 is a prior art embodiment showing a conventional assembly for a pop up stopper.

A drain assembly 10 including a sidewall portion defining a tab or blank 12 is shown in FIGS. 1, 2, and 13. The drain cover 9 has a strainer basket 27 disposed around the stem below the cover for staining fluid entering the drain. A nut 20 threadably engages the threaded portion of the drain body whereby the nut secures the drain body against one or more seals provided by o-rings or flexible gasket material provides a water tight seal.

As shown in FIGS. 1 and 13, a knock-out band can be used to cover a knock-out opening 14 in a drain assembly. The drain assembly may be supplied with a cooperatively engaging water tight band 72 covering the knock-out opening providing means for a single drain assembly to be purchased and used for sinks with and without overflows. The band 72 may be used to cover knock-out blanks 12 in drain assemblies where the user wishes to use the drain assembly in a sink without an overflow. The band is movable (slidable up or down the drain tube) and (rotational with respect to the drain tube), and preferably slidable over the drain conduit and stretchable or at least resilient enough to slide over the drain conduit over the hole, Preferably the band is elastic and has sufficient memory to snap back tightly over the knock-out hole providing a water tight seal. The band or "sleeve" may be formed as an o-ring or preferably a thin, flat band having dimensions sufficient to allow the width of the band to cover the knock-out opening when positioned there over. In one preferred embodiment the band includes a raised area which fits in and cooperatively engages the knock-out hole to provide a tighter fitting seal and easy alignment and improve aid in proper positioning of the band over the opening. Typically, a drain assembly would include at least one and preferably two opposing knock-out openings 70 and potentially could include multiple knock-out openings, therefore a band 72 would include corresponding sized and shaped raised areas 74 to align and seal each knock-out opening.

In a preferred embodiment a ridge line may optionally be formed above and below the knock-out opening or an indentation or reduced diameter section may be used to align and abut the outer edges of the band to aid in holding the band in position over the knock-out opening. The removable band may slidable or stretchable and comprise a polymer, elastomer, rubber, or combinations thereof having sufficient elasticity to be stretched over the knock-out port and provide a water tight seal.

The drain cover has a strainer basket or screen 27 disposed around the stopper body below the cover for staining fluid entering the drain. A nut 20 threadably engages the threaded portion of the drain assembly body whereby the nut secures the drain assembly body against one or more seals provided by o-rings or flexible gasket material provides a watertight seal.

The push pull drain assembly actuator 50 includes expansion tabs 51 or clips extending upward from the base ring 52 defining vertical inwardly facing prongs for alignment and cooperative biased engagement with the inner side walls 53 of the drain tube 103 for retaining the drain assembly in position via a friction fit. FIG. 13 shows the portion of the drain tube above the threaded section as a collar having a pair of opposing knock-out holes, and FIG. 20 shows a knock-out band or corresponding size and shape having a raised portion 73 for alignment and positioning of the knock-out band with the knock-out hole.

The pop-up drain stopper actuator assembly comprises or consists of an actuator housing 60 having at least two vertical flanges 61 and at least two guide tabs 51 extending from a base ring 52 spaced apart from and extending around a lower portion of the actuator housing 60. A spaced apart horizontal medial ring 63 and a bottom base ring 52 attach to and extend from the outer edge of the at least two vertical flanges and at least two guide tabs for aligning and cooperative slidable engagement with an inner wall of a drain body conduit. The actuator includes a support stem 90 including a threaded top stem 91 and an integral cam travel groove path 92 formed on a recessed face 93 of a bottom portion 94 of the support stem. A cam following pin 95 has a top distal end 96 covered with a coating or a polymer sleeve disposed in the integral cam travel groove path and the opposing distal end 99 of the cam following pin 95 projects downward into the center of a coiled spring 75 having a bottom end 101 resting on a floor 103 of the actuator housing 60 and has a top end 103 cooperatively engaging a smaller diameter bottom portion 105 of the support stem 90 which is inserted into the actuator housing. The cam following pin has an opposing bottom end secured to a bottom of the cam support. A spring clip or ring 107 holds the bottom end of the pin in position in the bottom of the support stem 90.

As shown in the figures, a cam following pin cooperatively engaging an integrally formed cam travel groove path 92 formed in on a recessed face 93 of a bottom portion of the actuator support stem 90. The threaded top stem and integral cam travel groove path formed in on the recessed face of a bottom portion of a support stem is generally heart shaped and the longitudinal cam following pin moves in a counter rotating direction around the groove to raise and lower the actuator support stem and attached stopper body. The distal end of the cam following pin extends into the coiled spring having a top end cooperatively engaging the bottom of the support stem. The integral cam travel groove path tapers at the corners forming a plurality of slight inclines 80 terminating in ridges 82 which urge the cam following pin to move counterclockwise and resists backward clockwise movement.

Only downward forces are needed to operate the stopper, a secure connection can be maintained during use and the entire assembly can be removed from the drain conduct by pulling up on the stopper.

The stopper assembly comprises or consists of a stopper body having a cover, a recessed threaded opening in the stopper body for cooperative threaded engagement with the threaded top stem, a seal member for cooperative engagement with a drain conduit providing sealing water tight engagement with the stopper body, and a removable screen cooperatively engaging a bottom surface of the stopper body and cooperatively engaging a inner sidewall of said drain conduit.

The actuator assembly 50 is inserted into the drain conduit connecting the sink to the drain pipe and comprises a longitudinal cylinder having a hollow core formed therein, the longitudinal cylinder contains a lower unthreaded portion, a larger diameter middle portion with exterior threads, and a larger diameter upper unthreaded portion terminating with a flange. The inner sidewalls of the drain conduit form a circular lip or step 57 at the intersection thereof where the drain conduit changes diameter. The base ring 52 of the actuator is supported by the top step 57 of the inner sidewall of the drain conduit.

As shown in the Figures, the screening basket 21 comprises one upper horizontal sleeve 10 with spaced apart vertical fingers 24 extending downward from the upper sleeve 7 to the lower sleeve 11 forming a cylindrical basket 21 which is open on the lower end. The spacing of the vertical fingers 24 is preferably one eighth of an inch but can be any selected spacing based on the size of the items one wishes to screen out of the water drained from the sink. The upper sleeve 7 is attached to the bottom surface of the stopper body 44 covered by the cap or cover 9. A resilient elastomeric sleeve 45 is attached to the bottom of the cap 9 to provide a seal between the drain plug cap 9 and the drain hole in the bottom of the sink.

The stopper body 44 includes generally flat cover 9 having a central axial recessed threaded sleeve extending from the bottom surface, whereby the central axial sleeve 46 includes inner threads for threadably receiving threads of a post or actuator support stem 57 extending from the actuator support 90 having a threaded distal end for supporting and mounting the stopper at one end thereof.

The screening basket 21 comprises two horizontal, spaced apart rings 7 and 11 connected, one ring over the other, to one another by a plurality of spaced apart vertical fingers 24 wherein the upper ring 7 is either rigidly or removably connected to the body of the drain plug cap 9. The preferred diameter of the first and second rims 7 and 11 is about one sixteenth inch less than the diameter of the drain body.

If an item falls into the drain opening it can be caught in the screen. To retrieve the item, the entire actuator assembly can be removed from the drain opening by pulling up on the stopper to dislodge the screen from the stopper and the articles can be easily removed and or the drain cleaned.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

We claim:

1. A pop-up drain stopper actuator assembly, comprising:

an actuator housing having at least two vertical flanges and at least two guide tabs extending from a side of a lower portion of said actuator housing with a spaced apart horizontal medial ring and a bottom base ring attaching to and extending from an outer edge of said at least two vertical flanges and at least two guide tabs for aligning and cooperative slidable engagement with an inner wall of a drain body conduit;

said actuator including a support stem including a threaded top stem and an integral cam travel groove path formed on a recessed face of a bottom portion of said support stem;

a cam following pin having a top distal end disposed in said integral cam travel groove path, said cam following pin projecting downward into a coiled spring having a top end cooperatively engaging a bottom portion of said support stem for insertion into said actuator housing;

said cam following pin to having an opposing end secured to a bottom of said cam support; and a stopper assembly including a stopper body having a cover, a recessed threaded opening in said stopper body for cooperative threaded engagement with said threaded top stem, a seal member for cooperative engagement with a drain conduit providing sealing water tight engagement with said stopper body, and a removable screen cooperatively engaging a bottom surface of said stopper body and cooperatively engaging a inner sidewall of said drain conduit.

2. The pop-up drain stopper actuator assembly of claim 1, further comprising a drain assembly comprising a longitudinal cylinder having a hollow core formed therein, said longitudinal cylinder containing a lower unthreaded portion, a middle portion with exterior threads, and an upper unthreaded portion terminating with a flange.

3. The pop-up drain stopper actuator assembly of claim 2, wherein said upper unthreaded portion includes a knock-out blank having a sidewall portion whose perimeter is thinner than said upper unthreaded portion providing for easy breakage and removal of said sidewall portion.

4. The pop-up drain stopper actuator assembly of claim 3, further including a resilient removable water tight band for covering the said knock-out blank opening.

5. The pop-up drain stopper actuator assembly of claim 2, said screen comprising two horizontal, spaced apart rings connected, one ring above another, to one another by a plurality of spaced apart vertical fingers wherein an upper ring is connected to a bottom side of said drain stopper body.

6. The pop-up drain stopper actuator assembly of claim 2, said screen comprising at least three horizontal, spaced apart rings connected, one ring above another, to one another by a plurality of spaced apart vertical fingers wherein an upper ring is connected to a bottom side of a drain stopper body.

* * * * *